US007153100B2

(12) United States Patent
Frampton et al.

(10) Patent No.: US 7,153,100 B2
(45) Date of Patent: Dec. 26, 2006

(54) CEILING FAN WITH RETRACTABLE FAN BLADES

(75) Inventors: Thomas C. Frampton, Zionsville, IN (US); Keith R. Schoene, Westfield, IN (US)

(73) Assignee: Fanimation, Inc., Zionsville, IN (US)

( * ) Notice: Subject to any disclaimer, the term of this patent is extended or adjusted under 35 U.S.C. 154(b) by 172 days.

(21) Appl. No.: 11/021,396

(22) Filed: Dec. 23, 2004

(65) Prior Publication Data

US 2006/0140769 A1 Jun. 29, 2006

(51) Int. Cl.
*B64C 11/28* (2006.01)

(52) U.S. Cl. ..... 416/5; 416/87; 416/143; 416/140

(58) Field of Classification Search ..... 416/5, 416/87, 136, 137, 140, 142, 143, 210 R
See application file for complete search history.

(56) References Cited

U.S. PATENT DOCUMENTS

| | | | |
|---|---|---|---|
| 1,361,785 | A | 12/1920 | Tucker |
| 1,445,402 | A | 2/1923 | LeVelle |
| 1,458,348 | A | 6/1923 | LeVelle |
| 1,682,044 | A | 8/1928 | Herion |
| 2,079,942 | A | 5/1937 | LeVelle |
| 2,142,080 | A | 1/1939 | Asplund |
| D173,609 | S | 12/1954 | Cockelaere |
| 2,974,731 | A | 3/1961 | Mader |
| 3,401,874 | A | 9/1968 | Covington |
| 3,565,544 | A | 2/1971 | Marshall |
| 4,139,330 | A | 2/1979 | Neal |
| 4,342,073 | A | 7/1982 | Ranten |
| 4,515,538 | A | 5/1985 | Shih |
| 4,621,977 | A | 11/1986 | Markwardt |
| 4,720,241 | A | 1/1988 | Markwardt |
| 4,729,725 | A | 3/1988 | Markwardt |
| 4,776,761 | A | 10/1988 | Diaz |
| 4,801,243 | A | 1/1989 | Norton |
| D304,229 | S | 10/1989 | Rezek |
| 4,884,947 | A | 12/1989 | Rezek |
| D321,933 | S | 11/1991 | Markwardt et al. |
| D322,475 | S | 12/1991 | Markwardt et al. |
| 5,154,579 | A | 10/1992 | Rezek |
| D330,759 | S | 11/1992 | Rezek |
| RE34,147 | E | 12/1992 | Rezek |
| D348,512 | S | 7/1994 | Markwardt et al. |
| 5,466,177 | A | 11/1995 | Aihara |
| 5,593,280 | A | 1/1997 | Takada et al. |
| D398,981 | S | 9/1998 | Wenzell |
| 6,027,309 | A | 2/2000 | Rawls et al. |
| 6,450,446 | B1 | 9/2002 | Holben |
| 6,547,519 | B1 | 4/2003 | deBlanc et al. |

*Primary Examiner*—Edward K. Look
*Assistant Examiner*—Dwayne J White
(74) *Attorney, Agent, or Firm*—Maginot, Moore & Beck

(57) ABSTRACT

A ceiling fan with retractable fan blades includes an electric motor operable to spin a rotor with a plurality of fan blades attached thereto. Each of the fan blades is operable to move between a closed position and an open position. A rotatable center ring is included on the rotor and connecting rods join each fan blade to the center ring. Rotation of the center ring relative to the rotor moves the plurality of connecting rods and fan blades in unison. The fan blades are spring biased toward the closed position. When the rotor rotates, centrifugal forces acting on the fan blades overcome the spring biasing forces and cause the fan blades to move toward the open position. A governor is positioned between the rotor and at least one of the fan blades to limit the speed of movement of the fan blades between the closed position and the open position. The governor may take the form of a fluid cylinder.

31 Claims, 15 Drawing Sheets

CEILING FAN WITH RETRACTABLE FAN BLADES

BACKGROUND

The present invention relates to the field of electric ceiling fans.

Electric ceiling fans are widely used for their ability to move and circulate air within a room. Manufacturers of electric ceiling fans offer numerous fan designs for their customers. Many designs have only aesthetic differences. However, some ceiling fan designs possess certain functional features that differentiate the fan from other fans.

One ceiling fan design that existed in the past is a ceiling fan with retractable fan blades. An example of such a ceiling fan is shown in U.S. Pat. No. 1,445,402 to Le Velle. This fan design includes an electric motor held within a motor housing and a plurality of fan blades. Each of the fan blades include one end pivotally attached to a rotor and an opposite free end. When the motor is not spinning the rotor, the fan blades are folded inward and interleaved near the motor housing. When the motor spins the rotor, centrifugal forces on the blades push the free end of the blades outward into an extended position away from the housing.

Some consumers may enjoy this design feature of retractable fan blades where the fan blades are largely hid from view when the fan is not in use. If an electric light is attached to the motor housing, the apparatus appears to be only a light when the fan is not in use. Accordingly, the retractable fan blade feature is particularly desirable to those who do not wish to see static fan blades in a room when the ceiling fan is not in use.

One problem with this type of existing ceiling fan design is that the blades tend to be somewhat unstable when moving between the folded position and the extended position. In particular, the fan blades tend to wobble while unfolding. The wobbling fan blades not only give an unstable appearance to the fan, but also produce an undesirable clunking noise. Accordingly, it would be desirable to provide a fan with retractable blades wherein the blades are stable appearing unfolding and do not produce the above-described undesirable noise.

Another problem with this type of ceiling fan design is that the blades tend to quickly move between the folded position and the extended position. This rapid outward movement of the fan blades not only produces a relatively loud noise when the blades reach their extended position, but also make the fan momentarily appear as if it were somewhat unstable. Individuals not expecting this rapid movement and relatively loud noise may be startled, making the fan undesirable to use. Accordingly, it would be desirable to provide a fan with retractable blades where the blades slowly move between the folded and unfolded positions with little noise and do so in a stable appearing manner.

SUMMARY

A ceiling fan with retractable fan blades comprises an electric motor operable to spin a rotor with a plurality of fan blades attached thereto. Each of the plurality of fan blades is operable to move between a closed position where the fan blades are drawn inward and an open position where the fan blades are extended. A center ring is included on the rotor and is concentric with the rotor. The center ring is free-floating, allowing the center ring to rotate relative to the rotor. A plurality of connecting rods are pivotably connected to the center ring at the ends of the connecting rods. The opposite ends of the connecting rods are respectively pivotably connected to one of the fan blades. Rotation of the center ring relative to the rotor is operable to move the plurality of connection rods and thereby move the plurality of blades together. Accordingly, all of the fan blades move in unison between the open and closed positions.

At least one wound spring is mounted on the rotor. The wound spring includes a first arm that is stationary relative to the rotor and a second arm that is moveable with respect to the rotor. The second arm contacts a post connected to one of the fan blades, such that movement of the fan blade results in movement of the second arm of the wound spring, thereby compressing or de-compressing the spring. In particular, movement of the fan blade to the open position compresses the spring and movement of the fan blade to the closed position decompresses the spring. Therefore, the spring biases the fan blade towards the closed position.

When the rotor rotates, centrifugal forces acting on the fan blades cause the fan blades to move to the open position. When the centrifugal forces overcome the spring forces biasing the fan blades toward the closed position, the fan blades move toward the open position. The speed of movement of the fan blades to the open position is limited, as a governor is positioned between the rotor and one of the plurality of fan blades. The governor is operable to reduce the speed at which the fan blades move between the open position and the closed position. In one embodiment, the governor comprises at least one fluid cylinder operable to move between an extended position and a retracted position. A first end of the fluid cylinder is connected to the rotor and a second end of the fluid cylinder is connected to one of the fan blades. When the fluid cylinder is in the extended position, the fan blades are in the closed position. When the fluid cylinder is in the retracted position, the fan blades are in the open position. The fluid cylinder may take the form of a pneumatic cylinder or a hydraulic cylinder which includes a cylinder member and a piston positioned within the cylinder member.

DESCRIPTION

Figure 1A:
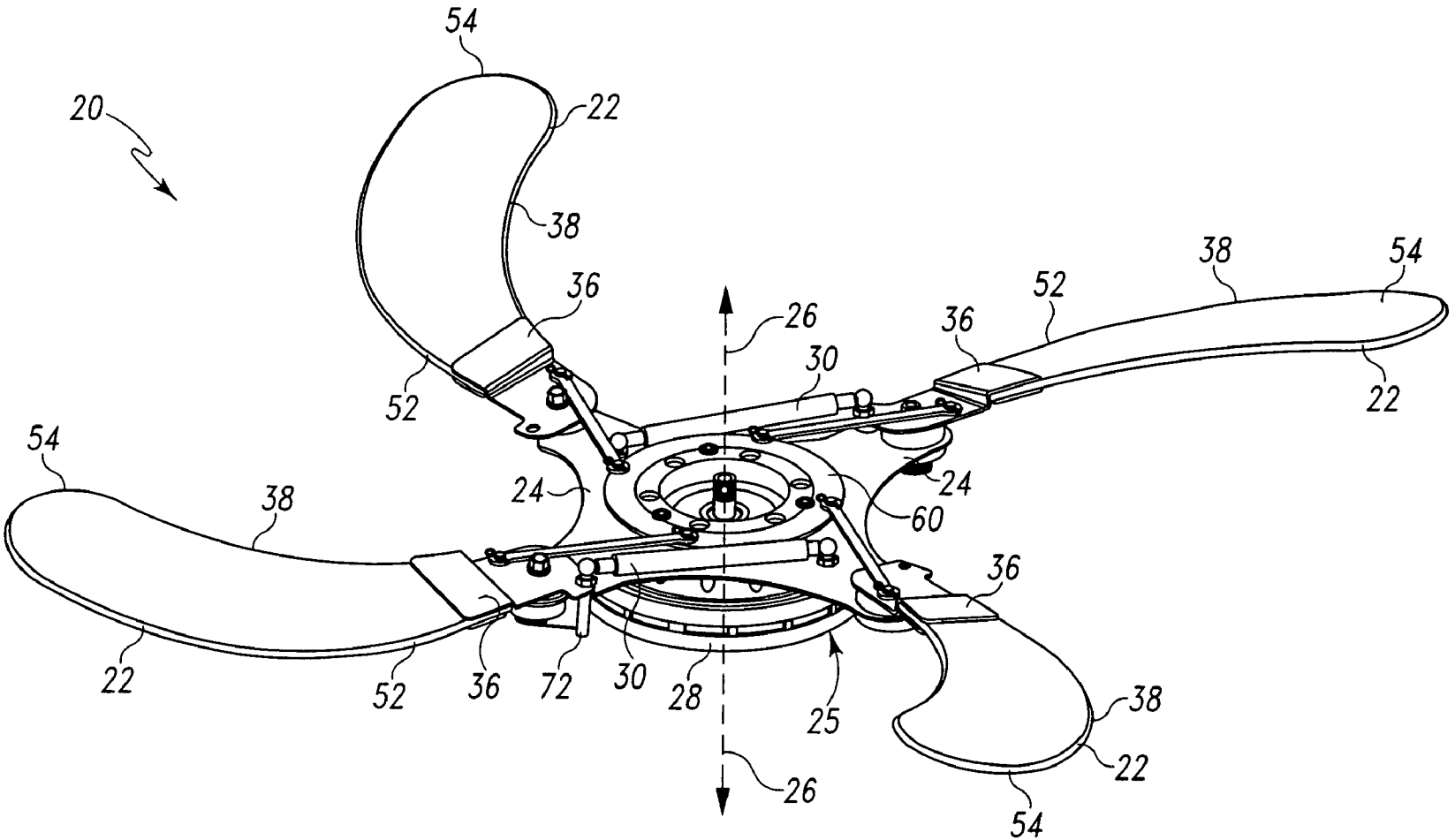
FIG. 1A shows a top perspective view of a ceiling fan with retractable fan blades that incorporates the features of the present invention therein, with the fan blades in an open position.

With reference to FIG. 1A a ceiling fan with retractable fan blades 20 includes a plurality of fan blades 22 pivotably attached to a rotor 24. The rotor 24 is operable to rotate about an axis 26. The rotor 24 is driven by an electric motor 25 retained within a motor housing 28. A governor in the form of one or more fluid cylinders 30 is provided between the fan blades 22 and the rotor 24. The governor is operable to limit the speed at which the fan blades 22 pivot with respect to the rotor 24.

The fan blades 22 of the ceiling fan 20 include a bracket portion 36 and a paddle portion 38. The paddle portion 38 of each blade 22 may be made of any one of a number of different materials including wood, metal, fiberglass or other material, depending upon the desired look of the ceiling fan 20. The paddle portion 38 includes a proximate end portion 52 and a distal end portion 54. The proximate end portion 52 of the paddle portion 38 is fixed to the bracket portion 36. The paddle portion 38 may be secured to the bracket portion 36 in a number of different ways, including the use of mechanical fasteners, such as bolts or screws, and/or adhesives, such as glue. Alternatively, the paddle portion 38 may be made integral with the bracket portion 36. The blades 22 are equally spaced apart upon the rotor. Accordingly, as shown in FIG. 1A, if the ceiling fan 20 includes four blades, each blade is separated from its neighboring blades by 90°.

Figure 4:
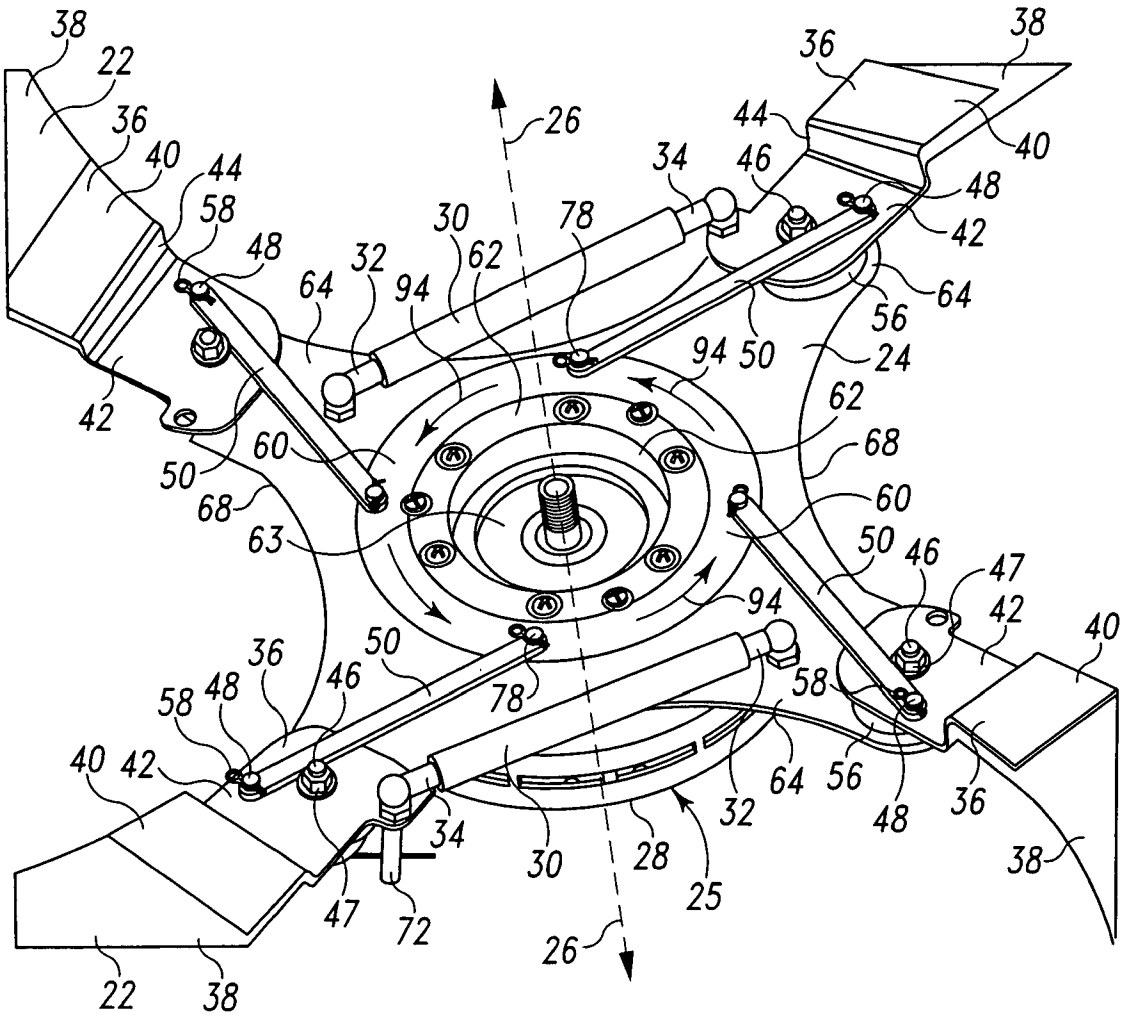
FIG. 4 shows a fragmentary top perspective view of the ceiling fan of FIG. 1A with an enlarged view of its fan rotor.

As best seen in FIG. 4, the bracket portion 36 of each blade 22 includes an upper portion 40 and a lower portion 42 joined by a connecting plate 44. The paddle portion 38 of each fan blade is connected to the upper portion 40 of the bracket portion 36. The upper portion 40 is offset from the lower portion 42 by the height of the connecting plate 44. The connecting plate 44 is slightly sloped from side to side, thereby making the upper portion 40 slightly tilted relative to the lower portion 42. This tilting of the upper portion provides for a tilted fan blade to encourage air movement.

A bolt 46 extends through a center hole in the lower portion 42 of each bracket 36. The bolt 46 secures the lower portion 42 to the rotor 24 and also provides a pivot point for the fan blade 22 to rotate with respect to the rotor 24. A locking nut 47 secures the bolt 46 in place. The lower portion 42 is preferably connected to the rotor by a friction reducing mechanism 56 that encourages pivoting movement of the fan blade 22 with respect to the rotor 24. The friction reducing mechanism 56 may take a number of different forms as will be recognized by those of skill in the art. For example, in one embodiment, the friction reducing mechanism 56 comprises an oil lubricated washer. In another embodiment, the friction reducing mechanism includes a cylinder and concentric disk arrangement with ball bearings provided between the cylinder and disk.

Figure 8:
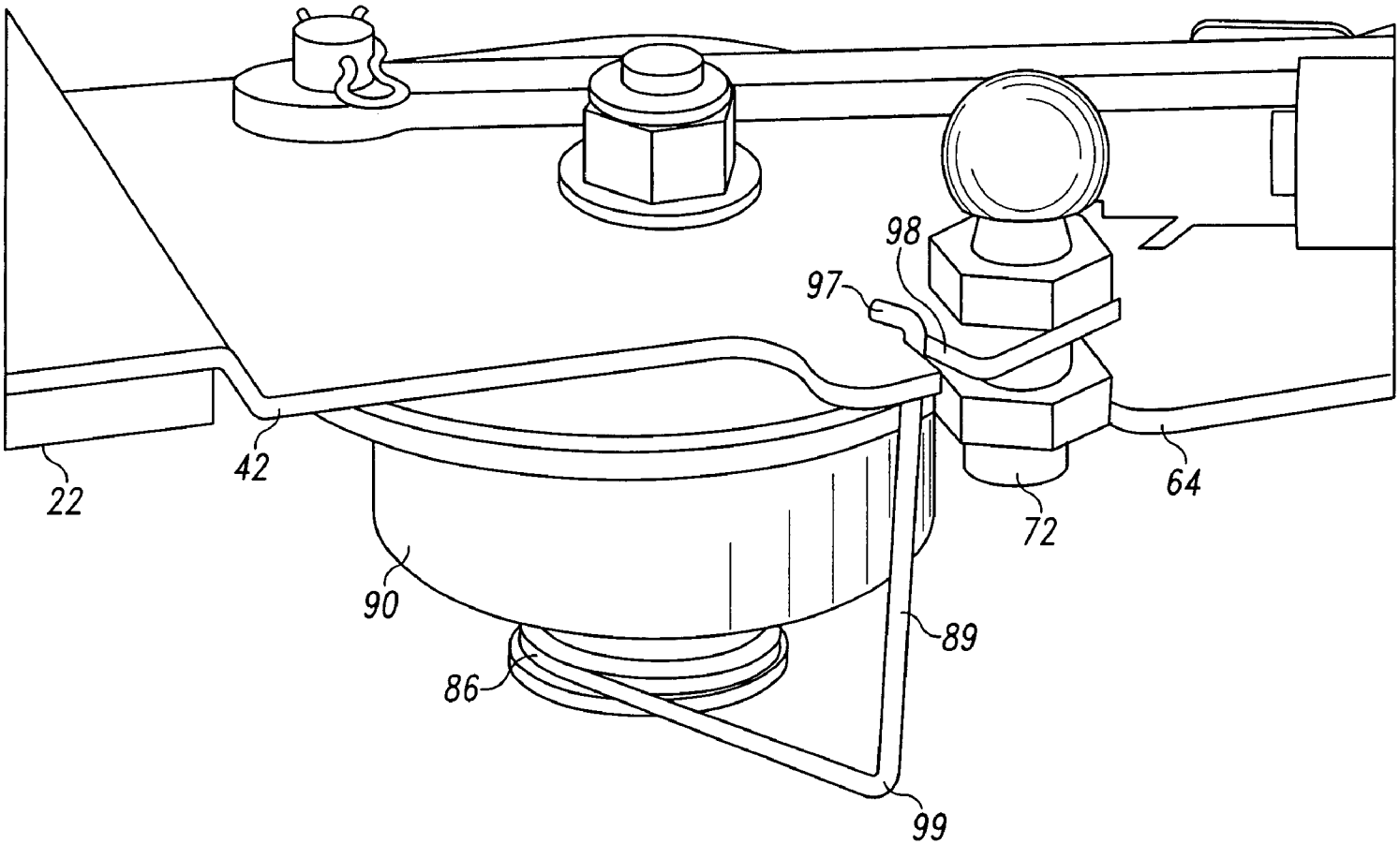
FIG. 8 shows a top perspective view of an alternative embodiment of the biasing mechanism of FIG. 5 with the fan blades in the open position.
Figure 9:
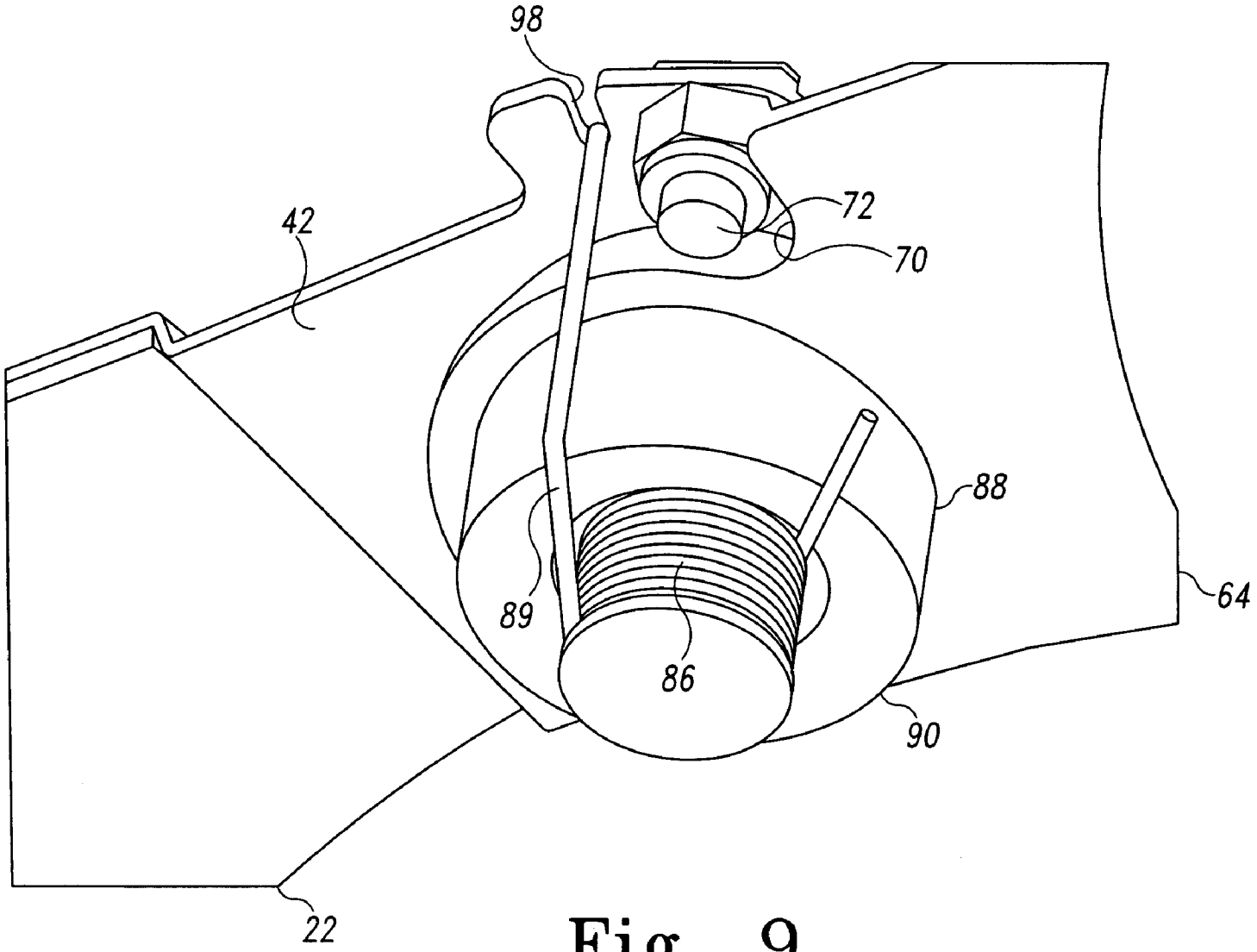
FIG. 9 shows a bottom perspective view of the alternative embodiment of the biasing mechanism of FIG. 8.

A knob 48 extends above the surface of the lower portion 42 on each fan blade 22. Each knob 48 is spaced apart from the associated bolt 46 on the lower portion 42 by a distance as shown in FIG. 4. A connecting rod 50 is pivotably connected to each knob 48 and spans between the knob 48 and a center ring 60. Each connecting rod 50 includes two ends with a hole defined in the rod 50 at each end. One end of the rod 50 is connected to the associated knob 48, with the knob 48 extending through the hole. A locking pin 58 is inserted through a pinhole in the knob 48 to prevent the connecting rod 50 from being detached from the knob 48. With this arrangement, the connecting rod 50 is pivotably connected to the fan blade 22. A post 72 is rigidly fixed to a perimeter portion of two of the lower portions 42 of the fan blades 22 (see, e.g., FIGS. 4–7). Each post 72 extends downward from the associated lower portion 42. As described in further detail below, the posts 72 are configured to contact the rotor and limit the amount of rotation of the fan blades. As also described in further detail below, the posts also provide a surface that helps to bias the fan blades toward a retracted position. In an alternative embodiment shown in FIGS. 8 and 9, the posts 72 are truncated and do not provide a surface for biasing the fan blades toward the retracted position. Instead, as shown in FIGS. 8 and 9, each lower portion 42 includes a notch 98 designed to receive a spring arm 89 that acts to bias the fan blades toward a retracted position. This action is also explained in further detail below.

The two fluid cylinders 30 shown in FIG. 4 act as a governor to limit the speed at which the fan blades 22 can pivot relative to the rotor 24. Each fluid cylinder 30 is mounted between the rotor 24 and the lower portion 42 of one of the fan blades 22. Each fluid cylinder 30 includes a first end 32 that may be moved linearly relative to a second end 34, thereby allowing the fluid cylinder to change in length. The first end 32 of the fluid cylinder 30 is pivotably mounted to the rotor. The opposite second end of the fluid cylinder is pivotably mounted to the lower portion 42 of one of the fan blades 22. In one alternative embodiment, the arrangement of each fluid cylinder 30 is reversed such that the first end 32 mounts to one of the fan blades and the second end mounts to the rotor. Movement of the fan blade 22 relative to the rotor 24 causes the first end 32 of the fluid cylinder 30 to move relative to the second end 34, thereby changing the overall length of the fluid cylinder as the first end pivots upon the rotor and the second end pivots on the fan blade.

The fluid cylinder is a pneumatic cylinder or alternatively may be a hydraulic cylinder. In one embodiment, a piston or rod of the fluid cylinder is located at a first end of the fluid cylinder and a cylinder member of the fluid cylinder is located at a second end of the fluid cylinder. Alternatively, the positions of the piston and cylinder member may be reversed. The piston is designed and dimensioned to fit precisely within the cylinder member and move back and forth along the axis of the cylinder member. One or more small orifices are provided in the piston or cylinder member to allow passage of fluid (e.g. gas such as air, or liquid such as oil or water) from one side of the piston to the other. As force is applied to ends of the fluid cylinder, the piston is encouraged to move in one direction or another within the cylinder. In the case of a pneumatic cylinder, as the piston moves, gas is compressed on one side of the piston and forced through the orifice to the opposite side of the piston. In the case of a hydraulic cylinder, a force is applied to the liquid as the piston attempts to move, but movement of the piston is restricted by the amount of liquid that passes through the orifices as a result of the force. In the case of either the pneumatic cylinder or the hydraulic cylinder, the speed of movement of the piston is dependent upon the force applied to the piston and how quickly gas or liquid is forced through the orifice. Accordingly, the speed of movement of the two ends of the fluid cylinder relative to each other depends upon the force applied to the fluid cylinder. In any event, because one end of the fluid cylinder is joined to the rotor and the opposite end of the fluid cylinder is joined to one of the pivoting fan blades, the speed at which the fan blade can pivot in relation to the rotor is limited by the force applied to the fluid cylinder by the fan blade. In one alternative embodiment, the fluid cylinder is configured with a valve that allows air or fluid to flow in one direction, but not in the opposite direction. Accordingly, the fluid cylinder may be configured to resist forces that act to shorten the overall length of the cylinder, but have little or no effect on forces that act to elongate the overall length of the cylinder.

With continued reference to FIG. 4, the rotor 24 is a metallic plate operable to rotate about the center axis 26. The rotor 24 is driven by a motor 25 housed within the motor housing 28 and arranged and disposed such that operation of the motor spins rotor 24. Such arrangements are known and will be readily apparent to those of ordinary skill in the art. A central hole 62 is formed in the rotor and a circular plate 63 of the motor housing 28 is positioned in the hole 62. The motor housing 28 is fixed to the rotor 24 such that rotation of the rotor 24 also results in rotation of the motor housing 28.

The rotor 24 includes a plurality of outwardly extending arms 64. One outwardly extending arm 64 is provided for each fan blade 22. As best seen in FIG. 3B, each arm 64 is generally rounded on its outer end. A shelf 70 is formed on the side of each arm 64. As described in further detail below, two of the shelves 70 are designed to function as stops for the posts 72 provided on two of the fan blades. The perimeter 68 of the rotor 24 is curved inward between each arm 64, providing a gently curving appearance to the rotor 24.

Referring again to FIG. 4, a center ring 60 is positioned upon the rotor 24. The center ring 60 is concentric with the rotor 24 about the center axis 26. The center ring 60 is retained upon the rotor 24, but is free floating with respect to the rotor 24. In particular, because the center ring 60 is connected to the fan blades 22 via the connecting rods 50, the center ring rotates along with the rotor and fan blades. However, because the center ring 60 is not fixed with respect to the rotor 24, the center ring is free to move relative to the rotor 24 about the central axis 26. As described in further detail below, this movement of the center ring 60 relative to the rotor occurs during opening and closing of the fan blades. A plurality of knobs 78 are included on the center ring 60. Like the knobs 48 on the lower portions 42 of the fan blades 22, the knobs 78 on the center ring 60 are used to pivotably connect the connecting rods 50 to the center ring 60. In particular, the knobs 78 fit into holes defined in the connecting rod, and locking pins are inserted through passages defined in the knobs 78 to pivotably retain the connecting rods 50 to the center ring 60 as shown in FIG. 4.

Figure 5:
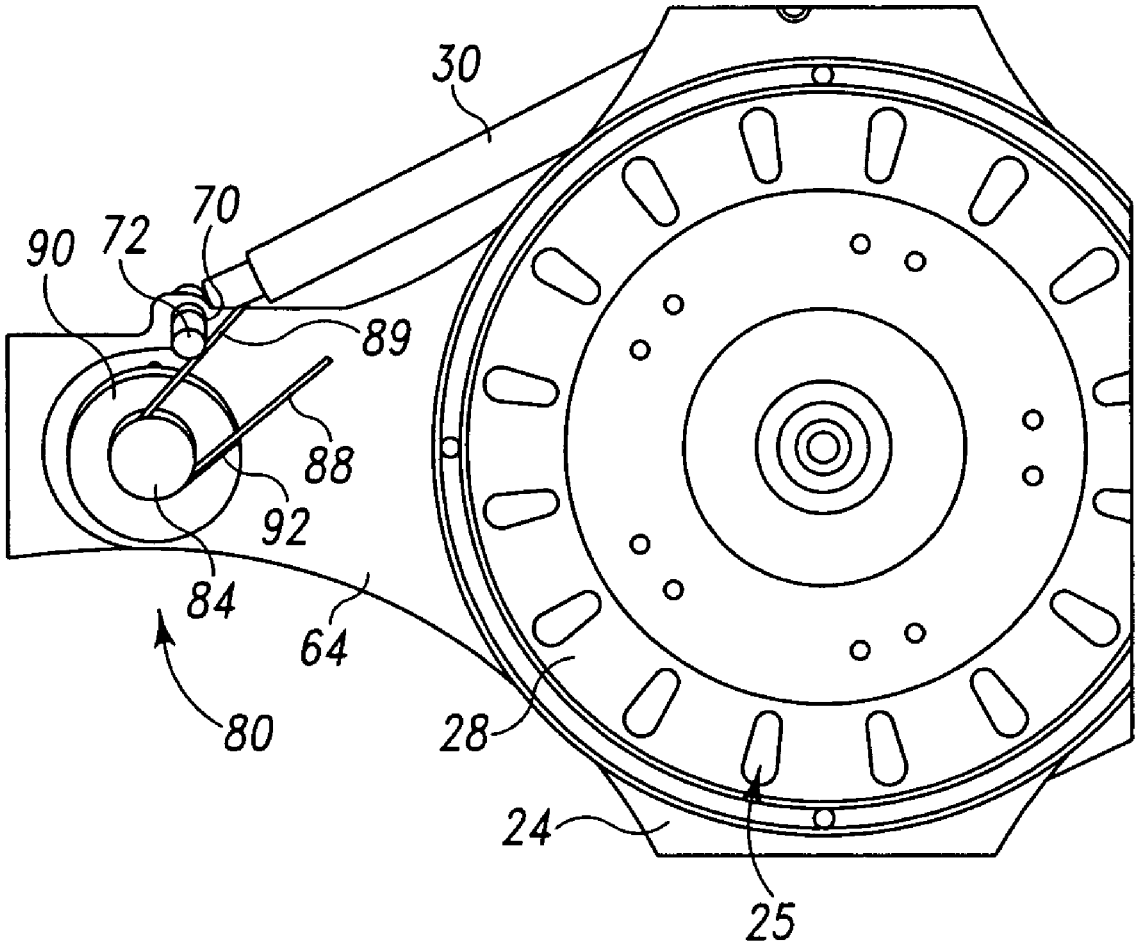
FIG. 5 shows an enlarged fragmentary bottom view of the ceiling fan of FIG. 3A with an enlarged view of its biasing mechanism.
Figure 6:
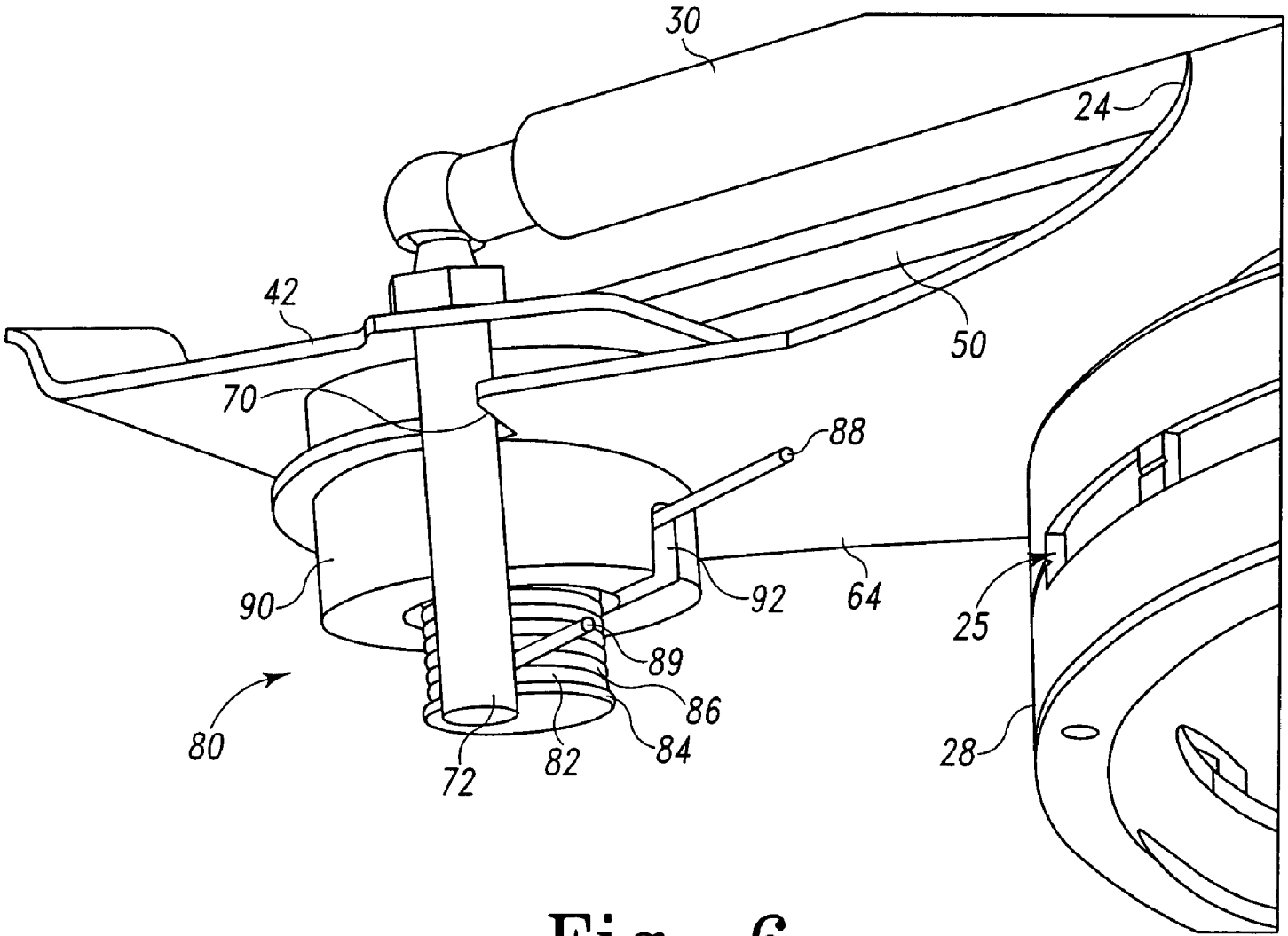
FIG. 6 shows a fragmentary bottom perspective view of the ceiling fan of FIG. 3A with the fan blades in the open position.
Figure 7:
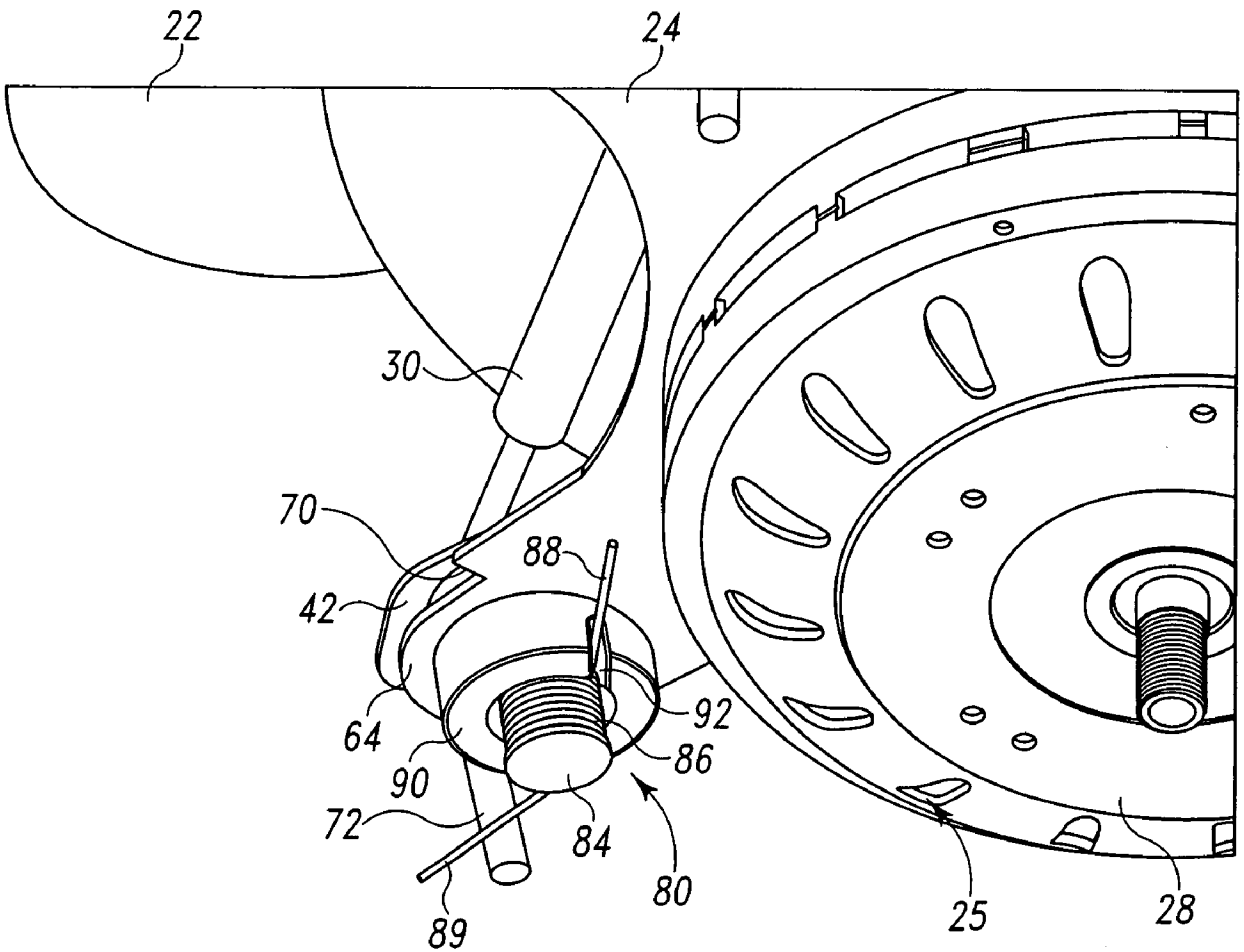
FIG. 7 shows a bottom perspective view of the ceiling fan of FIG. 3A with the fan blades in the closed position.

With reference now to FIGS. 5–7, a biasing mechanism 80 is positioned on the bottom of two of the arms 64 of the rotor 24. Each biasing mechanism 80 includes a cylindrical core 82 (see FIG. 6) that depends from the associated rotor arm 64. The cylindrical core 82 is rigid and terminates in a head 84. The cylindrical core 82 is formed of a metal. A wound spring 86 is concentrically positioned about the cylindrical core 82, and is trapped in place upon the cylindrical core between the rotor 24 and the head 84. The wound spring includes two laterally extending arms 88 and 89 that extend generally perpendicular to the axis of the cylindrical core. A donut-shaped disc 90 is attached to the rotor 24 and is positioned around the wound spring 86 and cylindrical core 82. The donut-shaped disc 90 is made of a plastic material. A channel 92 is formed in the donut shaped disc 90 that extends from the interior circumference of the disc to the exterior circumference of the disc. The channel 92 receives the first laterally extending arm 88 of the wound spring 86, substantially locking the arm 88 in a fixed position relative to the rotor 24. The second arm 89 of the wound spring 86 is free to rotate, as it is located below the donut-shaped disc.

In the alternative embodiment shown in FIGS. 8 and 9, the biasing mechanism's wound spring 86 includes one arm 89 that bends perpendicularly upward at an elbow 99 and makes contact with the notch 98 in the lower plate 42 of the fan blade 22. A hook 97 is provided at the end of the arm 89 to ensure engagement of the arm 89 with the notch 98.

Operation of the electric ceiling fan 20 is now described. Each of FIGS. 1A–1C, 2A–2C and 3A–3C, show a series of three views of the ceiling fan. These figures show the fan blades 22 moving from an extended or "open" or "unfolded" position (FIGS. 1A, 2A, and 3A), to an intermediate position (FIGS. 1B, 2B and 3B), and finally to a retracted or "closed" or "folded" position (FIGS. 3A, 3B and 3C).

Figure 2A:
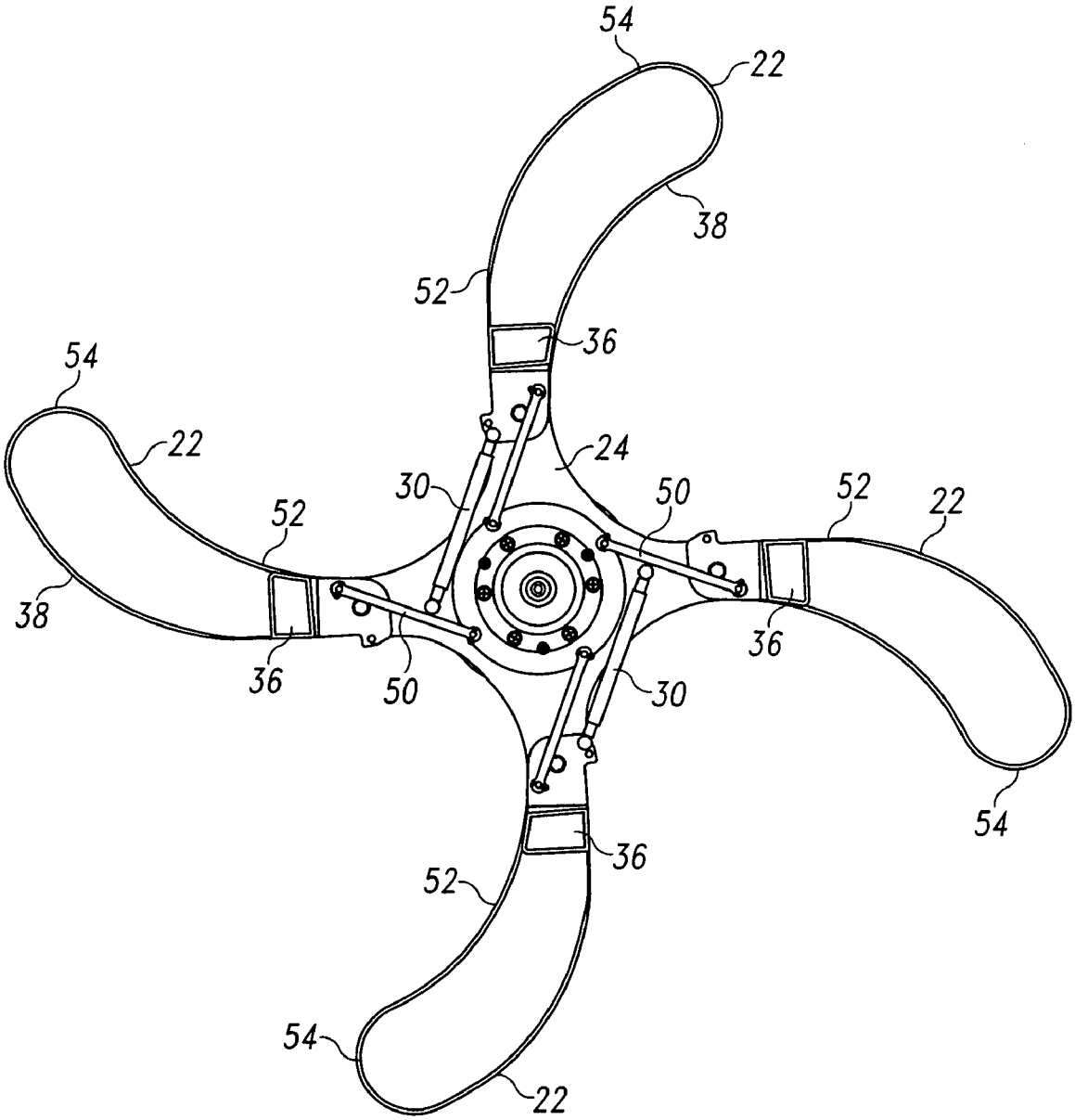
FIG. 2A shows a top elevational view of the ceiling fan of FIG. 1A with the fan blades in the open position.
Figure 3A:
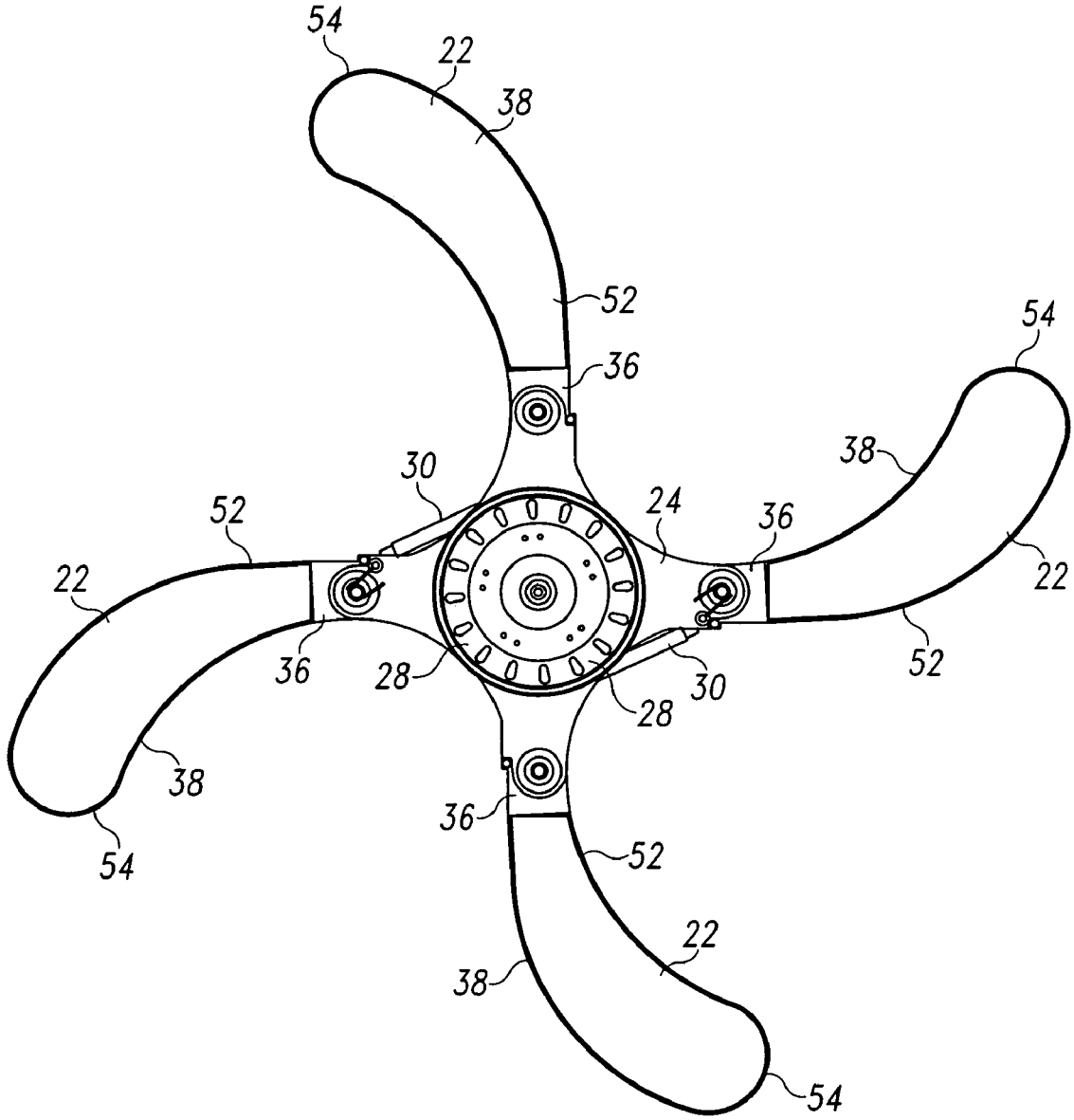
FIG. 3A shows a bottom elevational view of the ceiling fan of FIG. 1A with the fan blades in the open position.
Figure 3B:
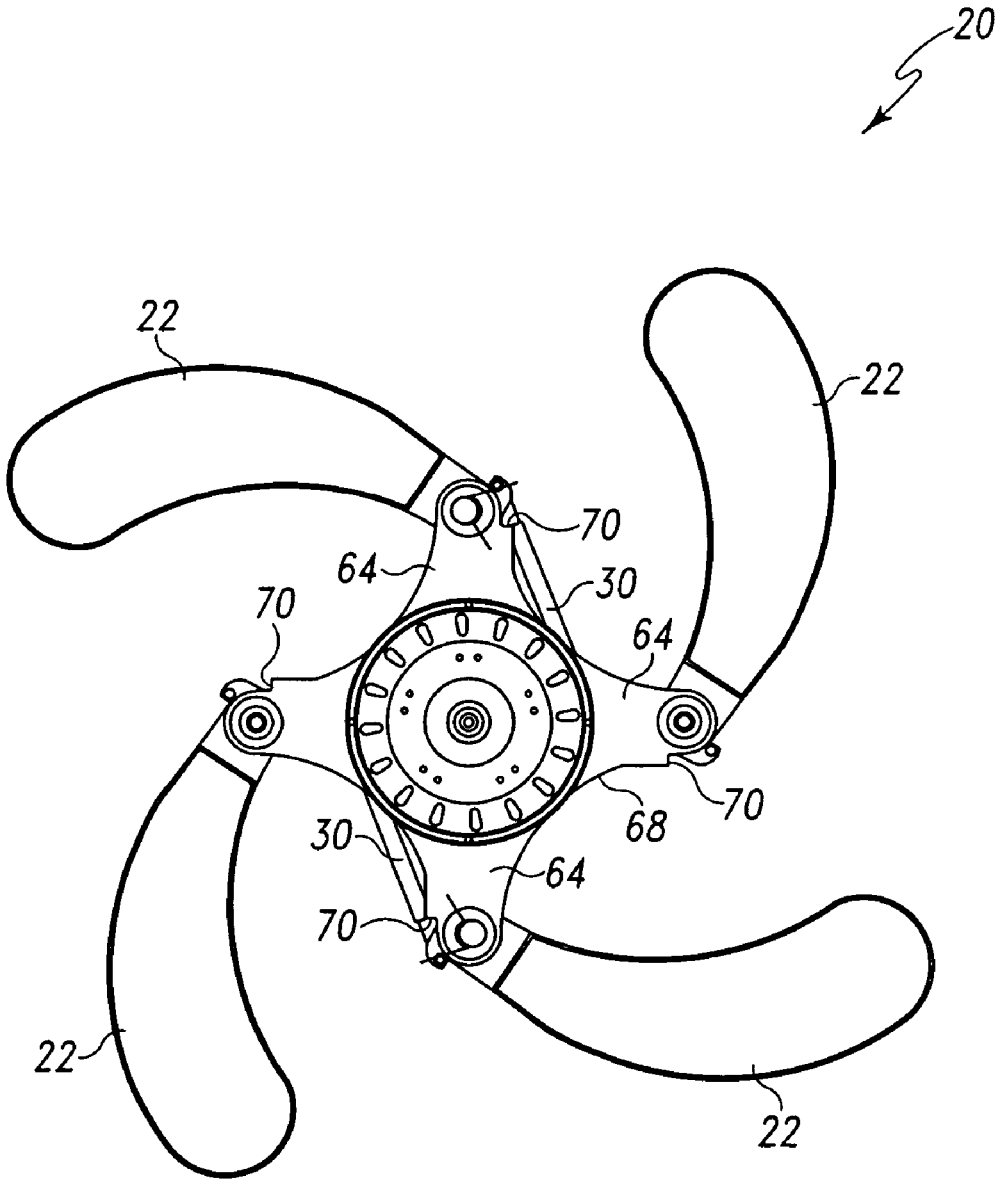
FIG. 3B shows a bottom elevational view of the ceiling fan of FIG. 1A with the fan blades in the intermediate position.
Figure 3C:
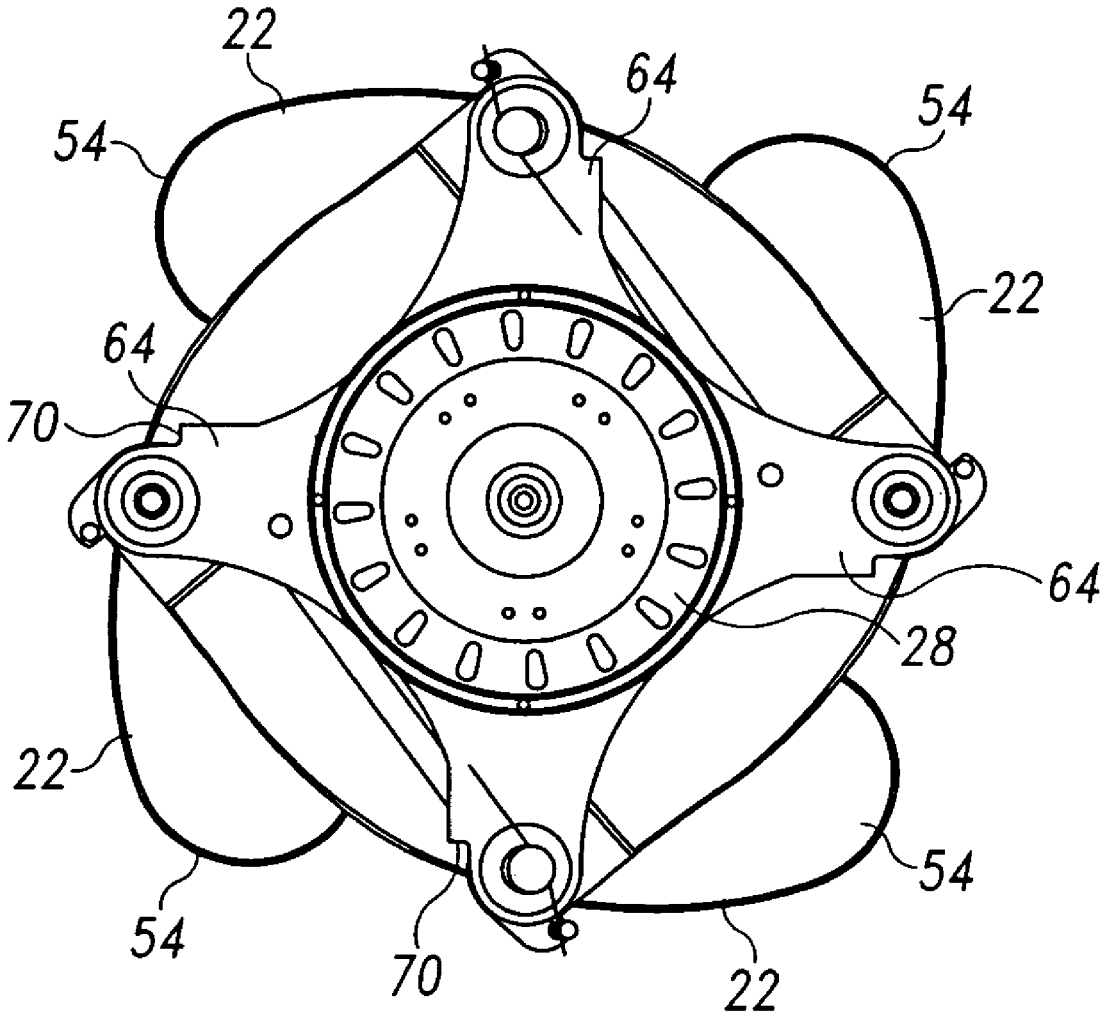
FIG. 3C shows a bottom elevational view of the ceiling fan of FIG. 1A with the fan blades in the closed position.

When electrical power is being provided to the motor of the ceiling fan 20, the motor rotates the rotor 24 and the fan blades 22 are fully extend in the open position shown in FIGS. 1A, 2A and 3A. In particular, rotation of the rotor 24 results in centrifugal forces acting on the fan blades 22 which are pivotably mounted to the rotor. These centrifugal forces bias the fan blades 22 including their respective distal end portions 54 away from the central axis, in a direction tangential to the direction of rotor rotation. As each fan blade 22 is being forced in this direction, each respective fan blade post 72 is forced against the respective shelf 70 on the respective rotor arm 64. This contact of the post 72 with the shelf 70 prevents the fan blade 22 from further pivoting with respect to the rotor 24 and essentially locks the fan blade in the open position as the fan rotates at full speed. This arrangement of the post 72 being forced against the shelf 70 on the rotor arm is best seen in FIGS. 5 and 6.

While the top end portion of the post 72 is pressed against the shelf 70, the lower end portion of the post 72 is in contact with the second arm 89 of the wound spring 86. Movement of the post 72 to this position causes the post 72 to compress the spring 86. Accordingly, in order for the fan blades 22 to remain in the open position, the centrifugal forces that encourage the fan blades 22 to pivot toward the open position and move the post 72 toward the shelf must be greater than the forces from the wound springs 86 that urge the post 72 to move away from the shelf 70. Therefore, the ceiling fan 20 is designed with an electric motor that rotates at any full operational speed with an angular velocity that causes sufficient centrifugal forces to be experienced by the fan blades 22 that overcome the opposing forces of the wound springs 86. In the alternative embodiment shown in FIGS. 8 and 9, as centrifugal forces encourage each fan blade away from the central axis, the lower plate 42 of the fan blade rotates, including the notch 98, thereby rotating the spring arm 89. Rotation of the spring arm 89 in this manner causes the wound spring 86 to compress. Again, the fan blades remain in the open position as long as the speed of the fan is such that the centrifugal forces acting upon the fan blade are greater than the forces from the springs 86 that encourage the fan blades to move toward the closed position.

Figure 1B:
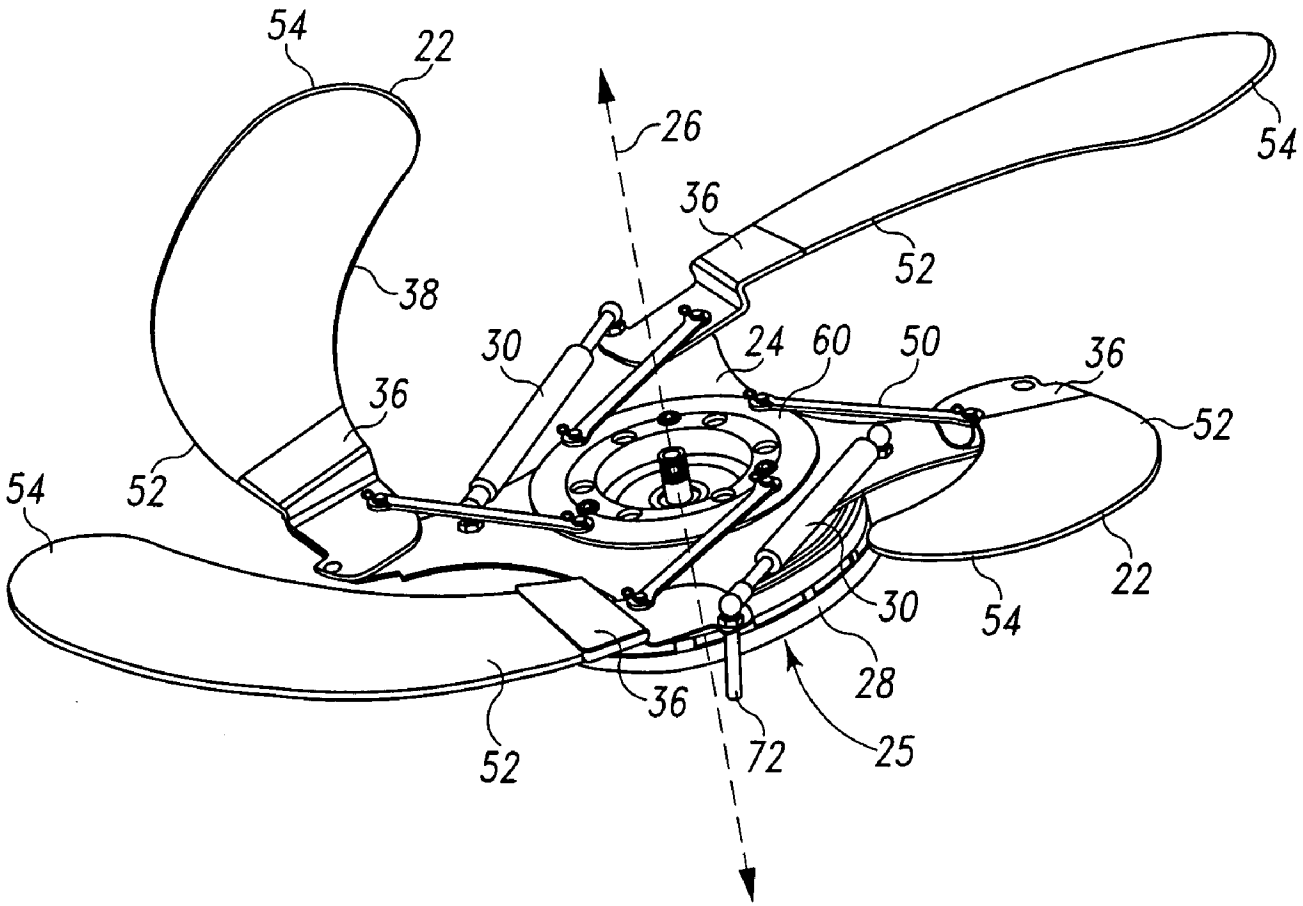
FIG. 1B shows a top perspective view of the ceiling fan of FIG. 1A with the fan blades in an intermediate position.
Figure 2B:
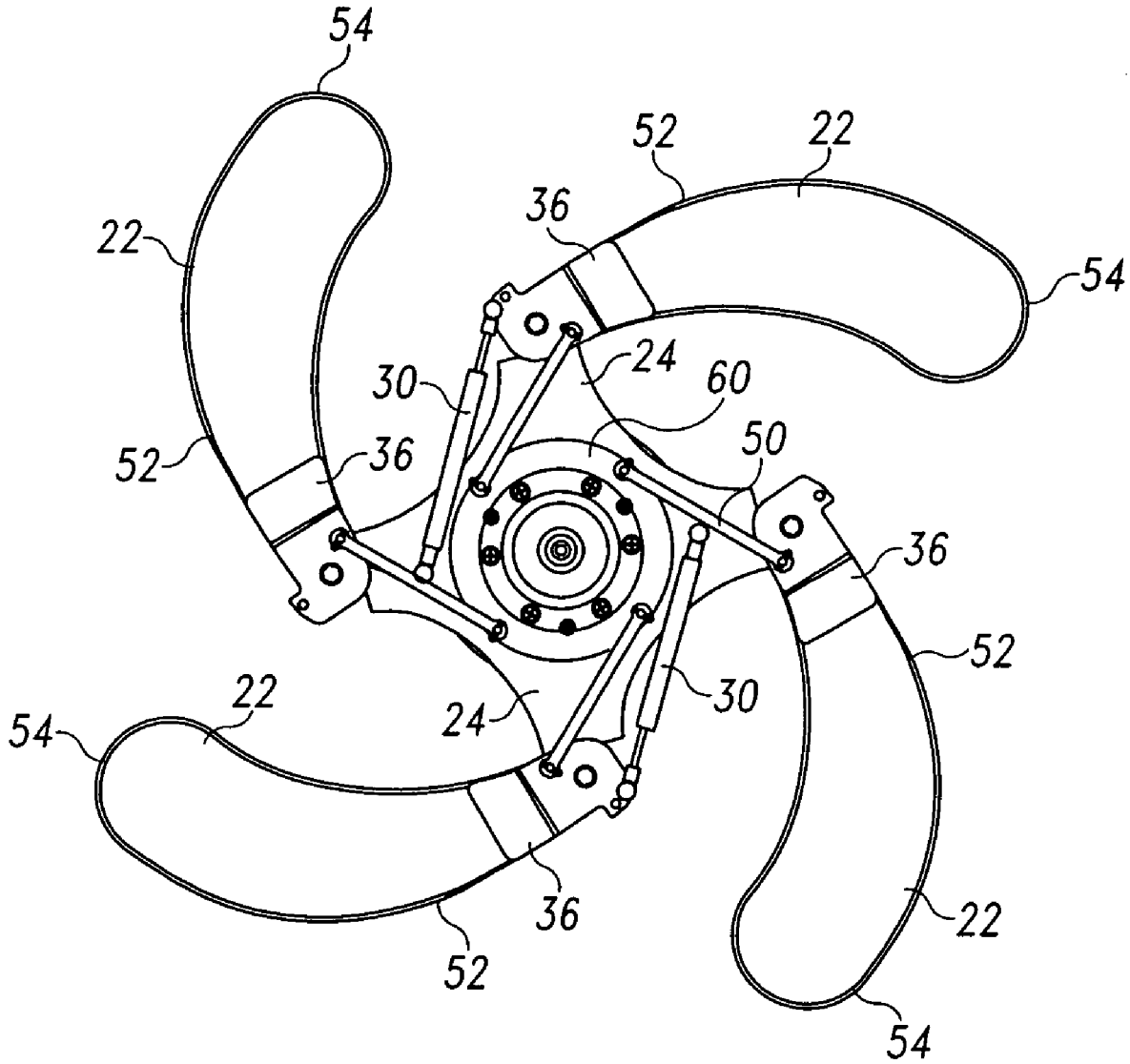
FIG. 2B shows a top elevational view of the ceiling fan of FIG. 1A with the fan blades in the intermediate position.

When electrical power is ceased to be supplied to the electric motor of the ceiling fan 20, the rotor 24 begins to slow down and the fan blades begin to retract toward the closed position due to the spring bias of the wound springs 86 against the respective posts 72 or, in the alternative embodiment shown in FIGS. 8 and 9, due to the spring bias of the wound springs 86 acting against the respective slots in the lower portion 42 of the fan blade 22. FIGS. 1B, 2B and 3B show the fan blades in an intermediate position as they move between the open position and the closed position. As the rotor 24 slows, the centrifugal forces acting on the fan blades are diminished. When the centrifugal forces become less than the forces from the spring 86 that are acting against the post 72, the fan blades begin to retract and move toward the closed position. In particular, as the second arm 89 of the compressed spring 86 is pressed against the post 72, the fan blade 22 attached to the post 72 is forced to pivot such that the distal end portion 54 of the fan blade moves toward the center axis 26 and the fan blades move toward the closed position.

As best seen in FIG. 4, movement of any one fan blade 22 toward the closed position causes the connecting rod 50 attached to that fan blade to shift. In particular, the fan blade end of the connecting rod 50 moves closer to the central axis 26, and the central ring end of the connecting rod moves in the direction of arrows 94. This shift of the connection rod 50 causes the free-floating center ring 60 to rotate in the direction of arrows 94 relative to the rotor 24. As the free-floating center ring 60 moves, other connecting rods pivotably attached to the center ring are also forced to move with the center ring. Accordingly, all the fan blades 22 on the ceiling fan 20 retract in unison, providing a smooth uniform appearance to the retracting blades. At the same time, the connecting rods 50 provide stability to the fan blades 22 during retraction.

During retraction of the fan blades 22, the fluid cylinder 30 mounted between the fan blades and the rotor prevent the fan blades from retracting too quickly toward the closed position. In particular, as the fan blades begin to move toward the closed position, the second end 34 of each fluid cylinder 30, which is connected to the lower portion 42 of the fan blade 22, begins to move away from the first end 32 of the fluid cylinder 30, which is connected to the rotor. As described above, the fluid cylinders 30 oppose this movement. Therefore, the fluid cylinders 30 provide a force that opposes retraction of the fan blades. This force is sufficient to slow the progress of the fan blades and contribute to a smooth and uniform retraction of the fan blades toward the closed position. Alternatively, in one alternative embodiment as discussed above, the fluid cylinders 30 provide little or no resistance to forces that tend to elongate the fluid cylinders 30. Accordingly, in this alternative embodiment, when power to the fan is shut off, the fan blades are retracted by the spring forces without opposition from the fluid cylinders as the fan slows.

Figure 1C:
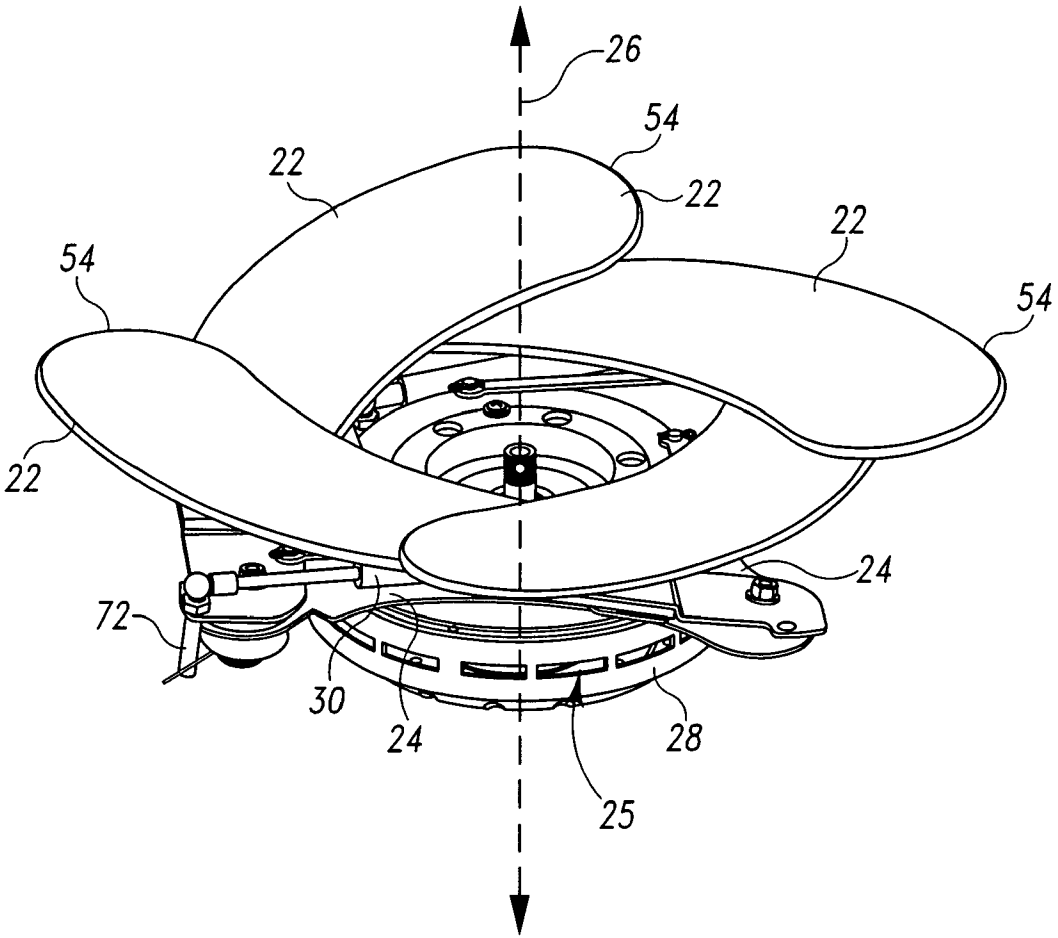
FIG. 1C shows a top perspective view of the ceiling fan of FIG. 1A with the fan blades in a closed position.
Figure 2C:
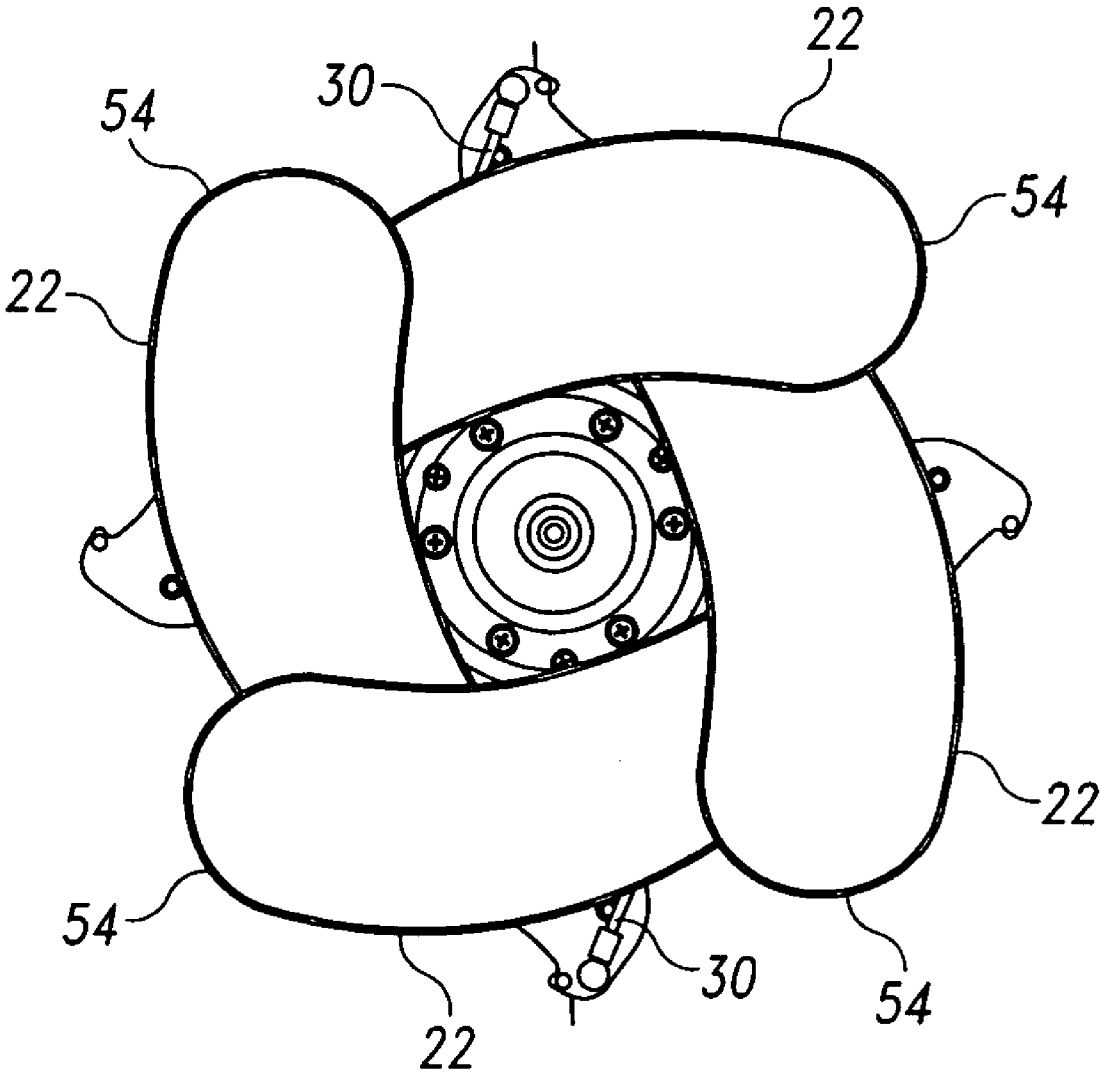
FIG. 2C shows a top elevational view of the ceiling fan of FIG. 1A with the fan blades in the closed position.

As shown in FIGS. 1C, 2C and 3C, after the rotor 24 slows and comes to a complete stop, the wound springs 86 have retracted the fan blades 22 into the closed position with the blades folded toward the center axis 26. In this position, the fan blades 22 are interleaved, with each distal end portion 54 positioned above a proximal end portion 52 of a neighboring fan blade. In this position, the fluid cylinders 30 are relatively elongated as they span from the rotor 24 to the fan blades 22. As best seen in FIGS. 3C and 7, the first arm 88 and second arm 89 are significantly separated in this position, with the wound springs 86 only somewhat compressed or not compressed at all. Depending upon the size of the fan blades and the size of the decorative covering, such as the motor housing 28, on the bottom of the ceiling fan 20, the fan blades 22 may or may not be visible in the closed position.

When the user desires to utilize the ceiling fan, a switch is flipped and electrical power is delivered to the electric motor of the ceiling fan 20. Initially, the rotor spins at only a slow speed as it begins to ramp up toward operating speed. At these slow speeds, the forces from the wound springs 86 that bias the fan blades toward the closed position are significant enough to suppress the centrifugal forces acting on the fan blades and keep the fan blades in the closed position as shown in FIGS. 1C, 2C and 3C. However, at some increased rotational speed as the rotor ramps up toward operational speed, the centrifugal forces overcome the spring biasing forces, and the fan blades 22 begin to extend outward, as shown in FIGS. 1B, 2B and 3B. As the fan blades 22 begin to extend outward, each post 72 is urged against the second arm 89 of a wound spring 86 and forces the second arm 89 toward the associated first arm 88, which is retained within one of the channels 92. At the same time, movement of the fan blades 22 causes the connecting rods 50 to shift and rotate the center ring 60 (shown in FIG. 4) opposite the direction of arrows 94 in relation to the rotor 24. Because all of the fan blades 22 are tied together through the center ring 60 and the associated connecting rods 50, the fan blades all move in unison, providing a smooth, uniform appearance as the fan blades open. Furthermore, the connecting rods provide stability to the fan blades and prevent significant wobbling of the fan blades during opening.

As the rotor 24 continues to spin, the centrifugal forces acting upon the fan blades 22 become more significant. These centrifugal forces encourage the fan blades to move toward the open position as shown in FIGS. 1A, 2A and 3A. And the fluid cylinders 30 extending between the fan blades 22 and the rotor 24 act as a governor that limits the speed at which the fan blades are allowed to open. Therefore, the fan blades 22 move from the closed to the open position at a relatively slow speed compared to the speed at which they would move from the closed to the open position if the fluid cylinders 30 were not present in the system. The fluid cylinders 30 may be configured to allow for slower or faster opening speeds, depending upon the desired operational parameters of the ceiling fan.

Although the present invention has been described with respect to certain preferred embodiments, it will be appreciated by those of skill in the art that other implementations and adaptations are possible. For example, a fluid cylinder may be provided between each fan blade and the rotor, rather than only two, as described above. Furthermore, a biasing mechanism 80 may be provided on each fan blade 22, instead of only two, as described above. As well, the ceiling fan 20 may include less than four fan blades 22 (such as three, two, or one blade), or may include more than four fan blades (such as five, six, or seven blades). Moreover, there are advantages to individual advancements described herein that may be obtained without incorporating other aspects described above. Therefore, the spirit and scope of the appended claims should not be limited to the description of the preferred embodiments contained herein.

What is claimed is:

1. A ceiling fan comprising:

a. a rotor;

b. a plurality of blades moveably attached to the rotor, each of the plurality of blades operable to move between a closed position and an open position; and c. a governor positioned between the rotor and at least one of the plurality of blades, the governor operable to reduce the speed at which the blades move between the open position and the closed position.

2. The ceiling fan of claim 1 wherein the governor includes at least one fluid cylinder.

3. The ceiling fan of claim 2 wherein the at least one fluid cylinder is operable to move between an extended configuration and a retracted configuration.

4. The ceiling fan of claim 3 wherein the at least one fluid cylinder is in the extended configuration when the plurality of blades are in the closed position, and the at least one fluid cylinder is in the retracted configuration when the plurality of blades are in the open position.

5. The ceiling fan of claim 2 wherein the at least one fluid cylinder includes a cylinder member attached to the rotor and a piston positioned within the cylinder and attached to at least one of the plurality of blades.

6. The ceiling fan of claim 2 wherein the at least one fluid cylinder includes a pneumatic cylinder.

7. The ceiling fan of claim 2 wherein the at least one fluid cylinder includes a hydraulic cylinder.

8. The ceiling fan of claim 1 wherein the plurality of blades pivot in relation to the rotor between the closed position and the open position.

9. The ceiling fan of claim 1 further comprising a center ring concentric with and rotatable relative to the rotor.

10. The ceiling fan of claim 9 further comprising a plurality of connecting rods, each of the plurality of connecting rods extending between one of the fan blades and the center ring.

11. The ceiling fan of claim 10 wherein rotation of the center ring relative to the rotor is operable to move the plurality of blades in unison.

12. The ceiling fan of claim 11 wherein the plurality of connection rods are pivotably connected to the center ring and the plurality of blades.

13. The ceiling fan of claim 1 further comprising a spring operatively connected between the rotor and one of the plurality of blades, the spring operable to bias the one of the plurality of blades towards the closed position.

14. The ceiling fan of claim 13 wherein spring is a wound spring.

15. The ceiling fan of claim 14 wherein the wound spring includes a first arm that is stationary relative to the rotor and a second arm that contacts the one of the plurality of blades and is movable relative to the rotor.

16. A ceiling fan comprising:

a. a rotor;

b. a plurality of blades pivotably attached to the rotor, each of the plurality of blades operable to move between a closed position and an open position; and c. means for restricting the speed of movement of the plurality of fan blades when the plurality of fan blades move from the closed position to the open position.

17. The ceiling fan of claim 16 wherein the means for restricting the speed of movement of the plurality of blades is operatively connected between one of the plurality of blades and the rotor.

18. A ceiling fan comprising:

a. a rotor;

b. a plurality of fan blades pivotably attached to the rotor; and c. a plurality of fluid cylinders extending between the plurality of fan blades and the rotor, each of the plurality of fluid cylinders including a first end and a second end, the first end pivotably connected to one of the plurality of fan blades and the second end pivotably connected to the rotor.

19. The ceiling fan of claim 18 wherein the plurality of fan blades are moveable between an open position and a closed position and the plurality of fluid cylinders are operable to restrict the speed at which the plurality of fan blades move toward the open position.

20. The ceiling fan of claim 18 further comprising a plurality of connecting rods, wherein (i) the rotor comprises a freely rotatable center ring, and (ii) each of the plurality of connecting rods extends between one of the fan blades and the center ring.

21. A method of operating a ceiling fan having (i) a rotor, and (iii) at least one fan blade movably attached to the rotor, comprising:

a. rotating the rotor whereby a centrifugal force is applied to the at least one fan blade to move the at least one fan blade from a closed position to an open position; and b. restricting the speed at which the at least fan blade moves from the closed position to the open position with a fluid cylinder.

22. The method of claim 21 further comprising spring biasing the at least one fan blade toward the closed position.

23. The method of claim 21, wherein said fluid cylinder is a gas cylinder.

24. The method of claim 21, wherein said fluid cylinder is a liquid cylinder.

25. A ceiling fan comprising:

a. a rotor;

b. at least one fan blade moveably attached to the rotor, the at least one fan blade being operable to move between a closed position and an open position; and c. at least one fluid cylinder operatively connected between the rotor and the at least one fan blade, the at least one fluid cylinder being operable to restrict the speed at which the at least one fan blade moves between the closed position and the open position.

26. The ceiling fan of claim 25 wherein the at least one fluid cylinder includes a pneumatic cylinder.

27. The ceiling fan of claim 25 wherein the at least one fluid cylinder includes a hydraulic cylinder.

28. The ceiling fan of claim 25 wherein the at least one fan blade is configured to pivot in relation to the rotor between the closed position and the open position.

29. The ceiling fan of claim 25, further comprising:

a center ring concentric with and rotatable relative to the rotor; and a connecting rod extending between the at least one fan blade and the center ring.

30. The ceiling fan of claim 29 wherein the connecting rod is pivotably connected to the center ring and the at least one fan blade.

31. The ceiling fan of claim 25 further comprising a spring operatively connected between the rotor and the at least one fan blade, the spring operable to bias the at least one fan blade towards the closed position.

* * * * *